US009463637B2

(12) United States Patent
Matsunaga

(10) Patent No.: US 9,463,637 B2
(45) Date of Patent: Oct. 11, 2016

(54) IMAGE FORMING DEVICE

(71) Applicant: FUJI XEROX CO., LTD., Tokyo (JP)

(72) Inventor: Takeshi Matsunaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/211,119

(22) Filed: Mar. 14, 2014

(65) Prior Publication Data

US 2015/0009255 A1 Jan. 8, 2015

(30) Foreign Application Priority Data

Jul. 8, 2013 (JP) ..... 2013-142795

(51) Int. Cl.
*B41J 2/045* (2006.01)
*B41J 2/205* (2006.01)
*B41J 11/42* (2006.01)

(52) U.S. Cl.
CPC ..... *B41J 2/2056* (2013.01); *B41J 11/425* (2013.01); *B41J 2/04503* (2013.01); *B41J 2/04595* (2013.01)

(58) Field of Classification Search
CPC ..... B41J 2/07; B41J 2/04593; B41J 2/0458; B41J 2/04563; B41J 29/393; B41J 2/04591; B41J 2/04581; B41J 2/04503; B41J 2/04595; B41J 2/5056
See application file for complete search history.

(56) References Cited

U.S. PATENT DOCUMENTS 6,193,347 B1 * 2/2001 Askeland ..... B41J 2/04505 347/15
7,252,372 B2 * 8/2007 Kusunoki et al. ..... 347/74
7,551,315 B2 * 6/2009 Hoshii et al. ..... 358/1.2
8,248,640 B2 8/2012 Tanaka et al.
2005/0200866 A1 9/2005 Hoshii et al.
2005/0219342 A1 * 10/2005 Kachi ..... B41J 11/002 347/102
2005/0248615 A1 11/2005 Ono
2006/0197787 A1 * 9/2006 Kusunoki et al. ..... 347/6
2008/0212826 A1 9/2008 Tanaka et al.
2011/0242178 A1 * 10/2011 Matoba ..... 347/16

FOREIGN PATENT DOCUMENTS

CN 101216688 7/2008
JP 2003-341034 12/2003
JP 2005-204053 7/2005
JP 2006-272962 10/2006
JP 2007-106113 4/2007

(Continued)

OTHER PUBLICATIONS

Japanese Office Action in JP2013-142795 dated May 17, 2016 and its English translation.

(Continued)

*Primary Examiner* — Geoffrey Mruk
(74) *Attorney, Agent, or Firm* — Fildes & Outland, P.C.

(57) ABSTRACT

An image forming device, includes: a conveying device that is capable of changing a conveyance speed of a recording medium; a plurality of liquid droplet ejecting devices which is arranged in the order along a conveyance direction of the recording medium which is conveyed by the conveying device; and a control unit which changes a concentration of a liquid droplet per unit area which is ejected from the liquid droplet ejecting device to be landed on the recording medium, in accordance with the conveyance speed, when a multi-color image is formed using liquid droplets of different colors which are ejected from two or more of the plurality of liquid droplet ejecting devices.

5 Claims, 10 Drawing Sheets

(56) References Cited

FOREIGN PATENT DOCUMENTS

| | | |
|---|---|---|
| JP | 2007-185968 | 7/2007 |
| JP | 2008-87312 | 4/2008 |
| JP | 2009-286577 | 12/2009 |
| JP | 2010-274637 | 12/2010 |
| JP | 2010-284925 | 12/2010 |
| JP | 2012-45853 | 3/2012 |
| JP | 2014-61624 | 4/2014 |

OTHER PUBLICATIONS

English language machine translation of JP2007-106113.
English language machine translation of JP2008-87312.
English language machine translation of JP2003-341034.
English language machine translation of JP2010-284925.
English language machine translation of JP2010-274637.
English language machine translation of JP2009-286577.
English language machine translation of JP2007-185968.
English language machine translation of JP2014-61624.
English language machine translation of JP2012-45853.
English language machine translation of JP2006-272962.
Office Action issued in corresponding Chinese patent application No. 20140083725.1, dated Jun. 22, 2016.
English language translation of Office Action issued in corresponding Chinese patent application No. 20140083725.1, dated Jun. 22, 2016.

* cited by examiner

IMAGE FORMING DEVICE

CROSS-REFERENCE TO RELATED APPLICATIONS

This application is based on and claims priority under 35 U.S.C. 119 from Japanese Patent Application No. 2013-142795 filed on Jul. 8, 2013.

BACKGROUND

Technical Field

The present invention relates to an image forming device.

SUMMARY

According to an aspect of the present invention, an image forming device, includes: a conveying device that is capable of changing a conveyance speed of a recording medium; a plurality of liquid droplet ejecting devices which is arranged in the order along a conveyance direction of the recording medium which is conveyed by the conveying device; and a control unit which changes a concentration of a liquid droplet per unit area which is ejected from the liquid droplet ejecting device to be landed on the recording medium, in accordance with the conveyance speed, when a multi-color image is formed using liquid droplets of different colors which are ejected from two or more of the plurality of liquid droplet ejecting devices.

BRIEF DESCRIPTION OF THE DRAWINGS

Exemplary embodiment(s) of the present invention will be described in detail based on the following figures, wherein

FIGS. 9A and 9B illustrate an example in which a concentration of a liquid droplet per unit area is changed by changing the number of liquid droplets per unit area in which FIG. 9A is an example where a conveyance speed is slow and FIG. 9B is an example where the number of subsequent liquid droplets is increased when a conveyance speed is faster than FIG. 9A.

DETAILED DESCRIPTION

An example of an image forming device according to an embodiment of the present invention will be described.

<Overall Configuration>

First, an overall configuration of an image forming device will be described.

Figure 10:
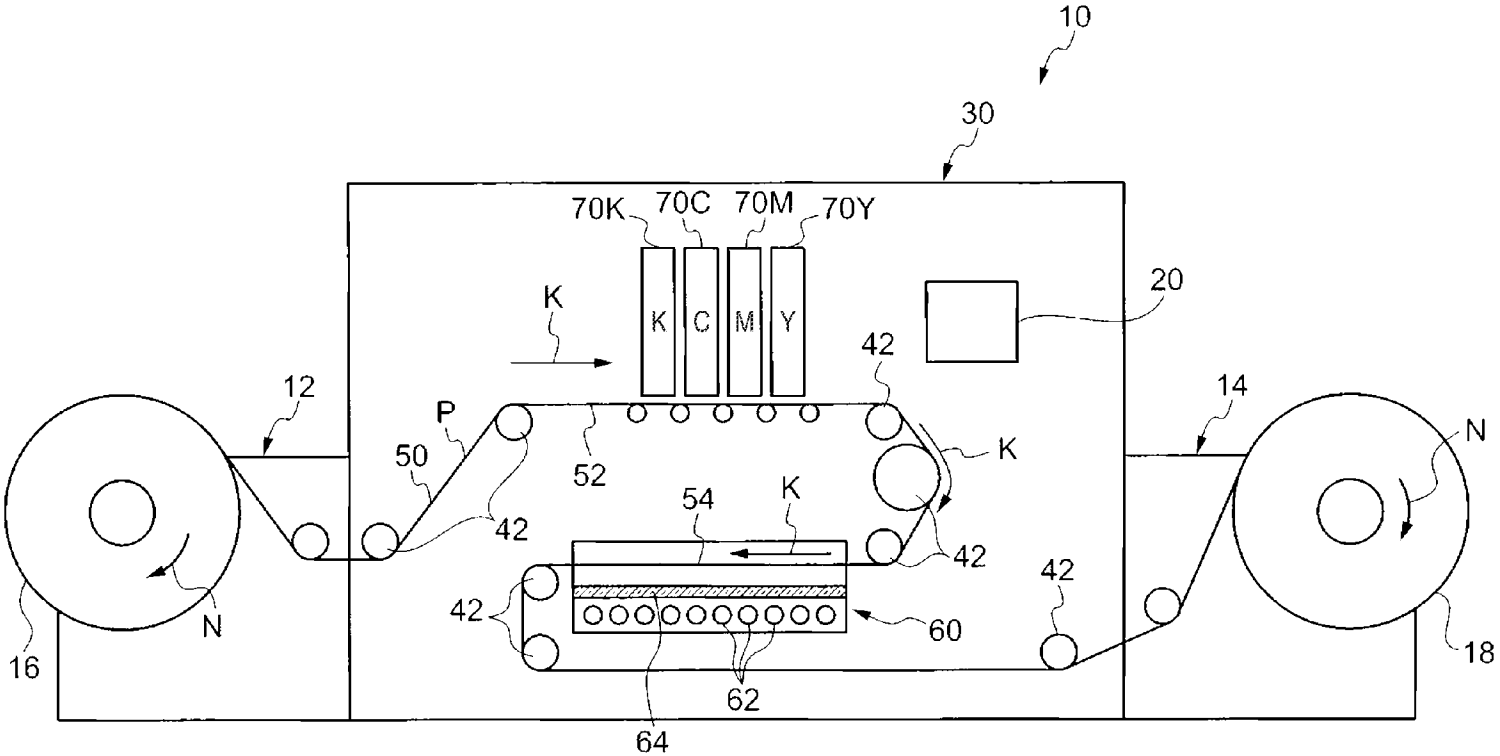
FIG. 10 is a diagram schematically illustrating an overall configuration of an image forming device.

An image forming device 10 illustrated in FIG. 10 is a high speed continuous paper inkjet printer which forms an image on a continuous paper P, which is conveyed at a high speed, in an inkjet manner.

The image forming device 10 includes an image forming unit 30 which forms an image on a continuous paper P, a pre-processing unit 12 which accommodates a continuous paper P to be supplied to the image forming unit 30, and a post-processing unit 14 which accommodates a continuous paper P which is discharged from the image forming unit 30.

A control unit 20 is provided in the image forming unit 30 of the image forming device 10. The control unit 20 performs various controls for the entire image forming device 10.

A buffer unit which adjusts a conveyance amount of the continuous paper P may be disposed between the pre-processing unit 12 and the image forming unit 30 and between the image forming unit 30 and the post-processing unit 14.

The continuous paper P is wound around a plurality of conveyance rollers 42 and conveyed along a conveyance path 50 which is formed in the image forming unit 30.

In the image forming unit 30, four liquid droplet ejecting heads 70K, 70C, 70M, and 70Y which eject ink drops (liquid droplets) on the continuous paper P which is conveyed along the conveyance path 50 and correspond to four colors of black K, cyan C, magenta M, and yellow Y are provided.

Hereinafter, if it is required to distinguish the liquid droplet ejecting heads 70 as black K, cyan C, magenta M, and yellow Y, K, C, M, and Y are post-fixed to the reference numerals and if it is not required to specifically distinguish the liquid droplet ejecting heads 70, K, C, M, and Y are not post-fixed to the reference numerals.

The liquid droplet ejecting heads 70 having respective colors are disposed so as to be opposed to an upper flat portion 52 which configures a part of the conveyance path 50. Further, the liquid droplet ejecting heads 70K, 70C, 70M, and 70Y are disposed in parallel to each other in this order in a conveyance direction of the continuous paper P which is indicated by an arrow K.

The liquid droplet ejecting heads 70 have an elongated shape which extends in a direction perpendicular to the conveyance direction K of the continuous paper P. Further, an image formation area by the liquid droplet ejecting heads 70 is set to be larger than a width of the continuous paper P.

The liquid droplet ejecting heads 70 are filled with respective color inks from ink tanks which are not illustrated. Further, water pigment inks in which a pigment is dispersed in a solvent having water as a main component are used as the inks of the embodiment. Further, in this embodiment, an ink which is slowly permeated is adopted for a high image quality.

As it will be described below, in the embodiment, the liquid droplet ejecting heads 70 may eject ink drops having three sizes of a large droplet, a medium droplet, and a small droplet. Further, the amount of liquid per one drop is increased in the order of the small droplet, the medium droplet, and the large droplet. The control unit 20 selects a size of the ink drops to eject the ink. In this embodiment, an amount of large liquid droplet is 11 pL, an amount of medium liquid droplet is 8 pL, and an amount of small liquid droplet is 5 pL.

A method of ejecting the ink drops in the liquid droplet ejecting head 70 is not specifically limited. Therefore, a well-known method such as a thermal method or a piezoelectric method may be used.

A dryer 60 is provided at a downstream side (a lower side of the liquid droplet ejecting head 70 in FIG. 10) of the conveyance direction K of the liquid droplet ejecting heads 70 in the image forming unit 30.

The dryer 60 evaporates and dries moisture of the ink drop (liquid droplet) which is ejected onto the continuous paper P by radiation heating of a plurality of infrared heaters 62. Further, the continuous paper P and the infrared heater 62 are divided by glass 64. The glass 64 is disposed so as to be opposed to a lower flat portion 54 which configures a part of the conveyance path 50.

The infrared heater 62 is cooled down by a fan which is not illustrated and high humidity air which is generated by evaporation of the moisture of the ink drops is discharged by an air blowing device which is not illustrated.

The pre-processing unit 12 includes a supply roll 16 around which the continuous paper P, which is supplied to the image forming unit 30, is wound and the supply roll 16 is supported on a frame member which is not illustrated so as to rotate in an arrow N direction.

In the meantime, the post-processing unit 14 includes a wind-up roll 18 which winds the continuous paper P on which an image is formed. The wind-up roll 18 receives a rotational force from a motor which is not illustrated to rotate in an arrow N direction so that the continuous paper P is conveyed along the conveyance path 50. Further, the conveyance speed of the continuous paper P may vary by changing the number of rotations of the motor which is not illustrated. The conveyance speed of the continuous paper P is 30 m/minute or higher and 200 m/minute or lower (variable width is 30 m/minute to 200 m/minute).

[Image Forming Operation]

Next, an outline of a process of forming an image on the continuous paper P by the image forming device 10 will be described.

A tensional force is applied to the continuous paper P in the conveyance direction K by rotating the wind-up roll 18 of the post-processing unit 14 so that the continuous paper P is conveyed along the conveyance path 50.

The respective color liquid droplet ejecting heads 70 eject respective color ink drops (liquid droplets) onto the continuous paper P which is conveyed from the upper flat portion 52 so that the image is formed on the continuous paper P.

When the continuous paper P is conveyed from the lower flat portion 54, the dryer 60 evaporates and dries the moisture of the ink drops (liquid droplets) and fixes the image on the continuous paper P.

The conveyance speed of the continuous paper P may vary so that the control unit 20 adjusts an ejecting frequency of the ink drops which are ejected by the liquid droplet ejecting heads 70 in accordance with the conveyance speed.

When the conveyance speed of the continuous paper P is high, a productivity of the image formation is improved but when the conveyance speed is low, conveyance stability is good and an image quality is improved. Therefore, a user may manipulate a control panel which is not illustrated to appropriately set the conveyance speed in accordance with a purpose.

<Control of Size (Liquid Amount) of Ink Drop (Liquid Droplet)>

Next, how to control the size (liquid amount) of the ink drop (liquid droplet) (control to select a large droplet, a medium droplet, and a small droplet) will be described.

When a secondary color image is formed using ink drops of two colors (liquid droplets) ejected from two different liquid droplet ejecting heads 70, the control unit 20 selects and ejects any one of the large droplet, the medium droplet, and the small droplet of subsequent ink drops which are ejected from the liquid droplet ejecting head 70 at the downstream side of the conveyance direction in accordance with the conveyance speed of the continuous paper P, subsequently to the ink drop (large droplet) which is ejected from the liquid droplet ejecting head 70 at the upstream side of the conveyance direction.

<Operational Effect>

Next, an operational effect of the embodiment will be described while describing the control to select and eject the size of the subsequent ink drops (liquid droplet), that is, the large droplet, the medium droplet, and the small droplet when a secondary color is formed.

(Relationship Between Conveyance Speed and Optical Density)

First, a relationship between an optical density OD of a primary color and the optical density OD of a secondary color and a conveyance speed of the continuous paper P will be described. Further, the optical density OD is used to objectively express an image density and is a value defined by OD=log 10 (1/R) when a reflectance is R.

Figure 1:
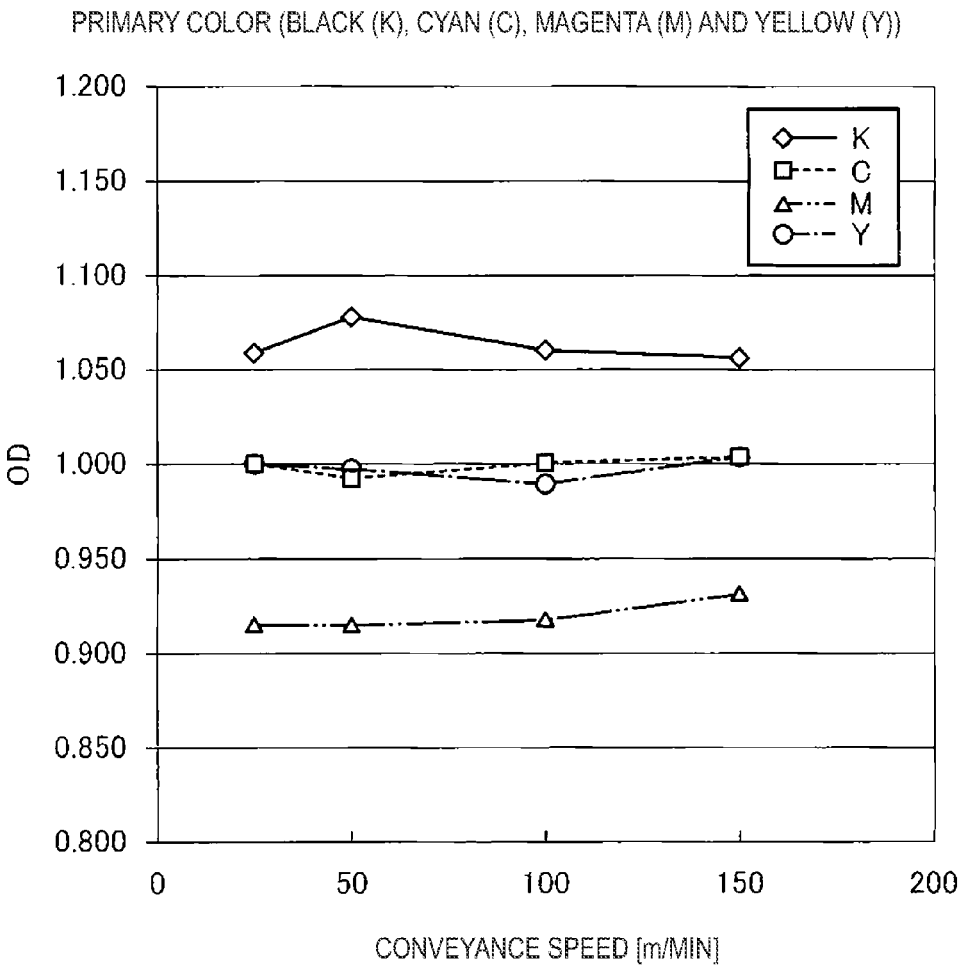
FIG. 1 is a graph illustrating a relationship between a conveyance speed and an optical density in a primary color.

FIG. 1 illustrates a relationship between a conveyance speed and an optical density OD of the primary color image which is formed by ink drops of respective colors (large droplets) of black K, cyan C, magenta M, and yellow Y. As seen from FIG. 1, the optical density OD of the primary color is substantially constant without depending on the conveyance speed.

Figure 2:
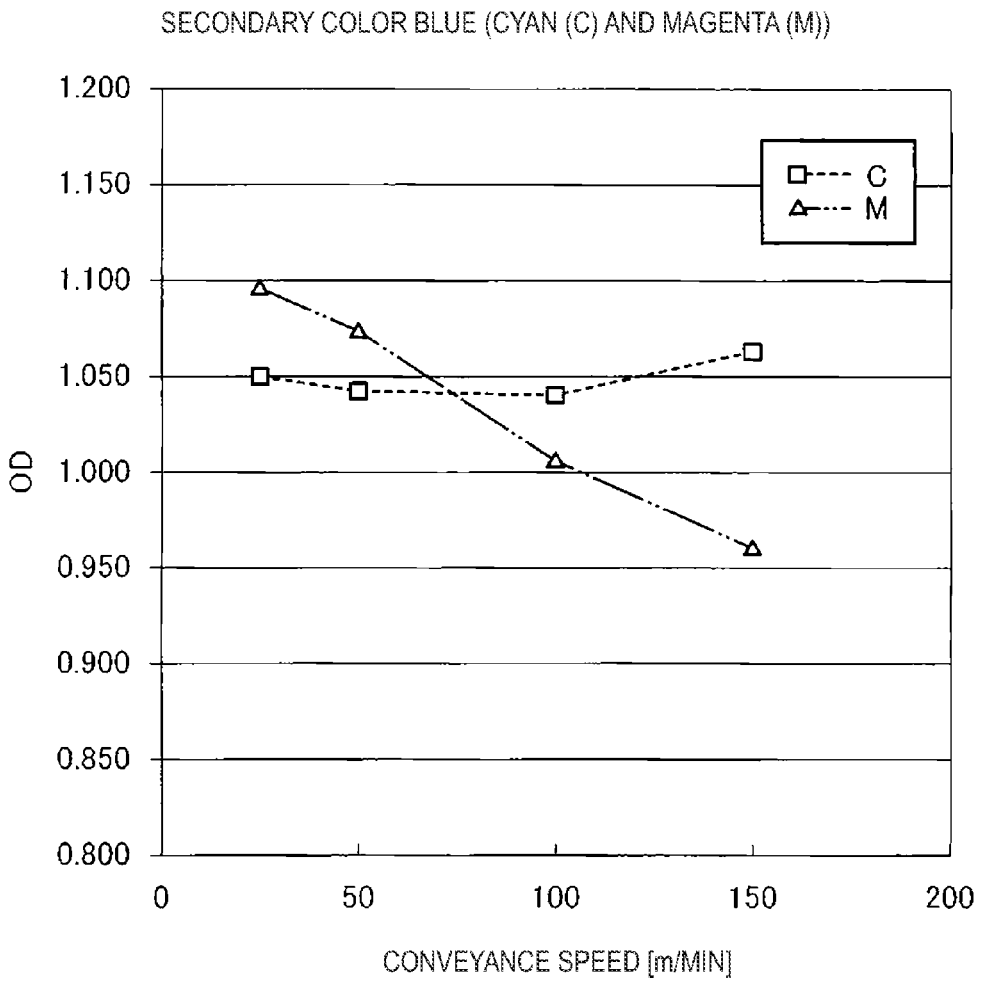
FIG. 2 is a graph illustrating a relationship between a conveyance speed and an optical density of a starting color cyan and a subsequent color magenta in a secondary color blue.

FIG. 2 illustrates a relationship between an optical density and a conveyance speed of a starting color cyan C and a subsequent color magenta M in a secondary color blue in which the starting color is cyan C and the subsequent color is magenta M. As seen from FIG. 2, the optical density OD of the starting color cyan C is substantially constant without depending on the conveyance speed but the optical density of the subsequent color magenta M is lowered as the conveyance speed becomes higher.

Figure 3:
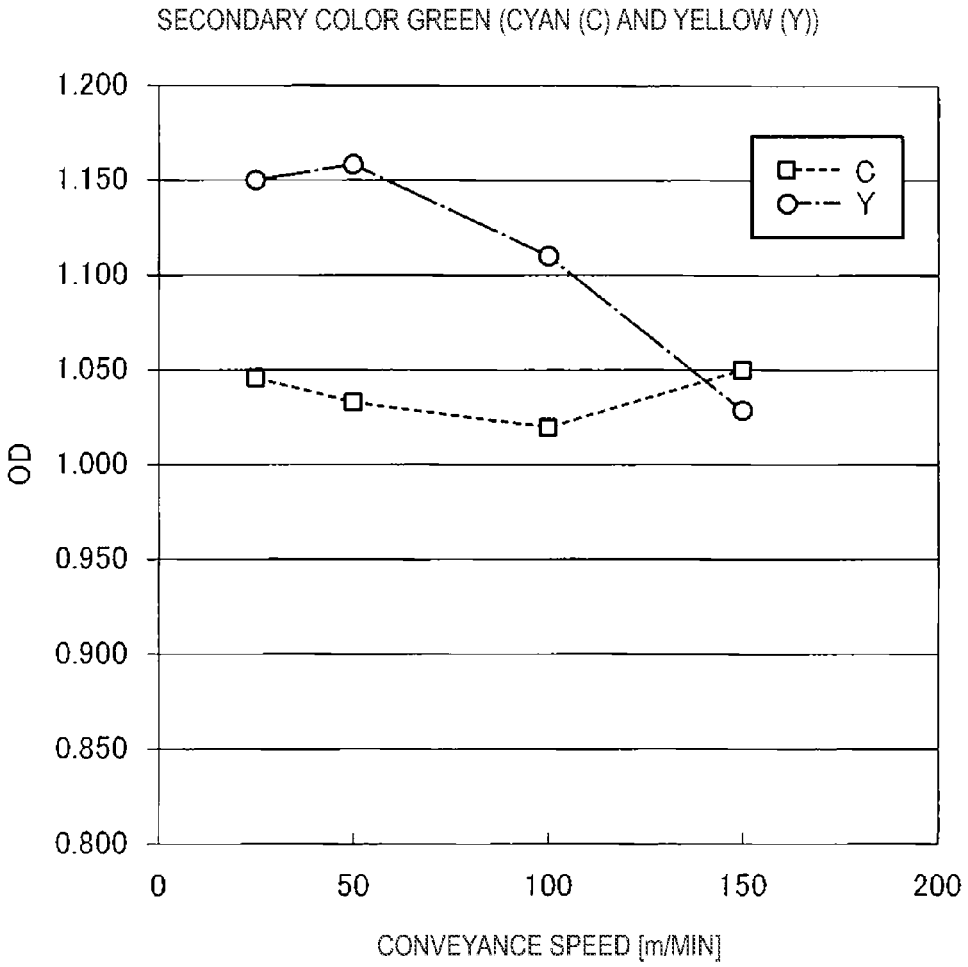
FIG. 3 is a graph illustrating a relationship between a conveyance speed and an optical density of a starting color cyan and a subsequent color yellow in a secondary color green.

FIG. 3 illustrates a relationship between an optical density and a conveyance speed of a starting color cyan C and a subsequent color yellow Y in a secondary color green in which the starting color is cyan C and the subsequent color is yellow Y. As seen from FIG. 3, the optical density of the starting color cyan C is substantially constant without depending on the conveyance speed but the optical density of the subsequent color yellow Y is lowered as the conveyance speed becomes higher.

Figure 4:
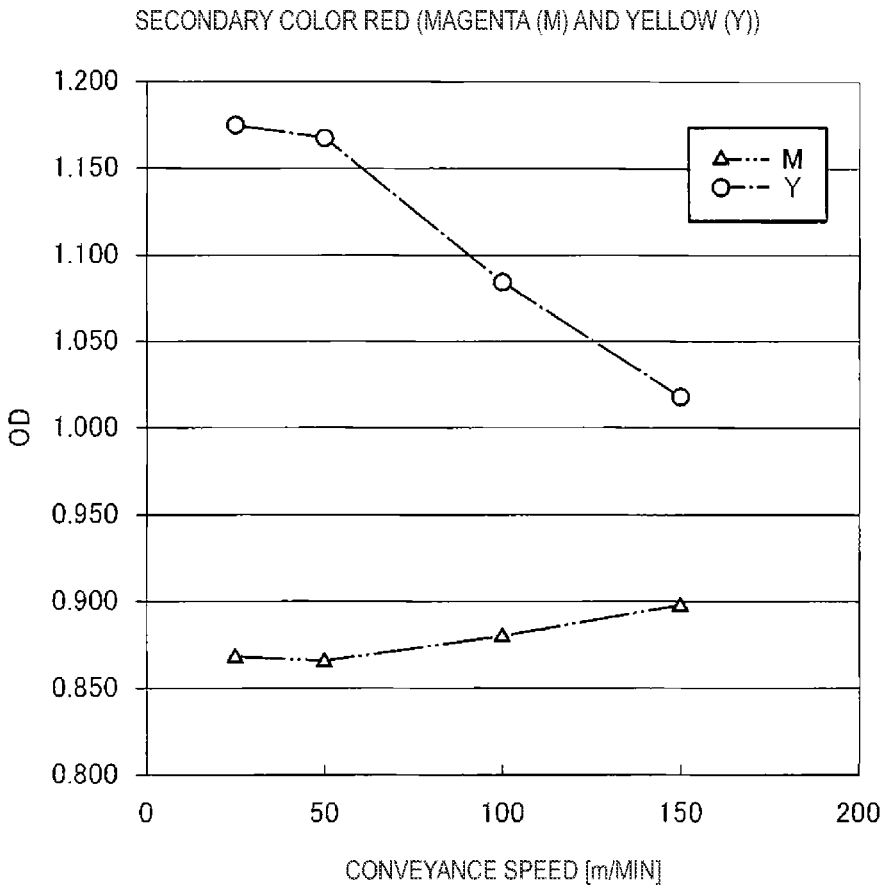
FIG. 4 is a graph illustrating a relationship between a conveyance speed and an optical density of a starting color magenta and a subsequent color yellow in a secondary color red.

FIG. 4 illustrates a relationship between an optical density and a conveyance speed of a starting color magenta M and a subsequent color yellow Y in a secondary color red in which the starting color is magenta M and the subsequent color is yellow Y. As seen from FIG. 4, the optical density of the starting color magenta M is substantially constant without depending on the conveyance speed but the optical density of the subsequent color yellow Y is lowered as the conveyance speed becomes higher.

As illustrated in FIGS. 2 to 4, the optical density of the subsequent ink drops (subsequent color) is changed by the conveyance speed. Further, as described above, the optical density of the subsequent ink drops (subsequent color) is changed by the conveyance speed so that the optical density OD or the values in L*a*b* (color space) of the secondary color which is represented by liquid droplets of two colors is changed by the conveyance speed of continuous paper P. As a result, ΔE (color difference) of the image is generated by the conveyance speed of the continuous paper P. That is, ΔE (color difference) occurs in an image to be formed by the conveyance speed of the continuous paper P (ΔE (color difference) is increased). Here, L*a*b* is a specification of a color space which is defined by International Commission on Illumination (CIE) on 1976.

(Control Method)

As described above, the optical density OD of the subsequent color is changed by the conveyance speed of the continuous paper P (specifically, the optical density OD of the subsequent color is lowered as the conveyance speed becomes higher. See FIGS. 2 to 4). Further, the optical density of the subsequent ink drop (subsequent color) is changed by the conveyance speed so that ΔE (color difference) of the image formed by the conveyance speed of the continuous paper P is increased.

Accordingly, in the embodiment, when a secondary color image is formed using two color ink drops (liquid droplets) ejected from two different liquid droplet ejecting heads 70, as described above, the control unit 20 selects and ejects one of the large droplet, the medium droplet, and the small droplet of subsequent ink drops which are ejected from the liquid droplet ejecting head 70 at the downstream side of the conveyance direction in accordance with the conveyance speed of the continuous paper P, subsequently to the ink drop (large droplet) which is ejected from the liquid droplet ejecting head 70 at the upstream side of the conveyance direction so that ΔE (color difference) of the image is reduced.

Specifically, when the conveyance speed is low, the optical density of the subsequent color is high. In this case, the subsequent ink drop is ejected as a small droplet. Further, as the conveyance speed becomes higher, the optical density of the subsequent color is lowered. In this case, the subsequent ink drop is ejected as a medium droplet or a large droplet.

A relationship between the conveyance speed and the size (large droplet, medium droplet, and small droplet) of the subsequent ink drop in which ΔE (color difference) of the image is reduced is obtained for every secondary color in advance by an experiment. The result is stored in a storage unit of the control unit 20. The control unit 20 selects (determines) the size (large droplet, medium droplet, and small droplet) of the ink drop which is subsequently ejected in accordance with the conveyance speed based on the result.

A degree of changing the optical density of the subsequent ink drop (subsequent color) by the conveyance speed is affected by a physical property (e.g., penetration characteristic) of an ink, an interval between respective color liquid droplet ejecting heads 70, and a penetration characteristic of the continuous paper P. So, the degree of changing the optical density is obtained in advance for every device by an experiment.

(Example of Method of Determining Size of Subsequent Ink Drop)

Next, an example of a method of determining a size (large droplet, medium droplet, and small droplet) of the subsequent ink drop in which ΔE (color difference) of the image is reduced will be described.

[Suppression of Variation of Optical Density]

First, a case in which ΔE (color difference) of the image is reduced by suppressing the variation of the optical density will be described with an example in which an image is formed of 100% of secondary color blue using a starting color cyan C and a subsequent color magenta M.

Figure 5:
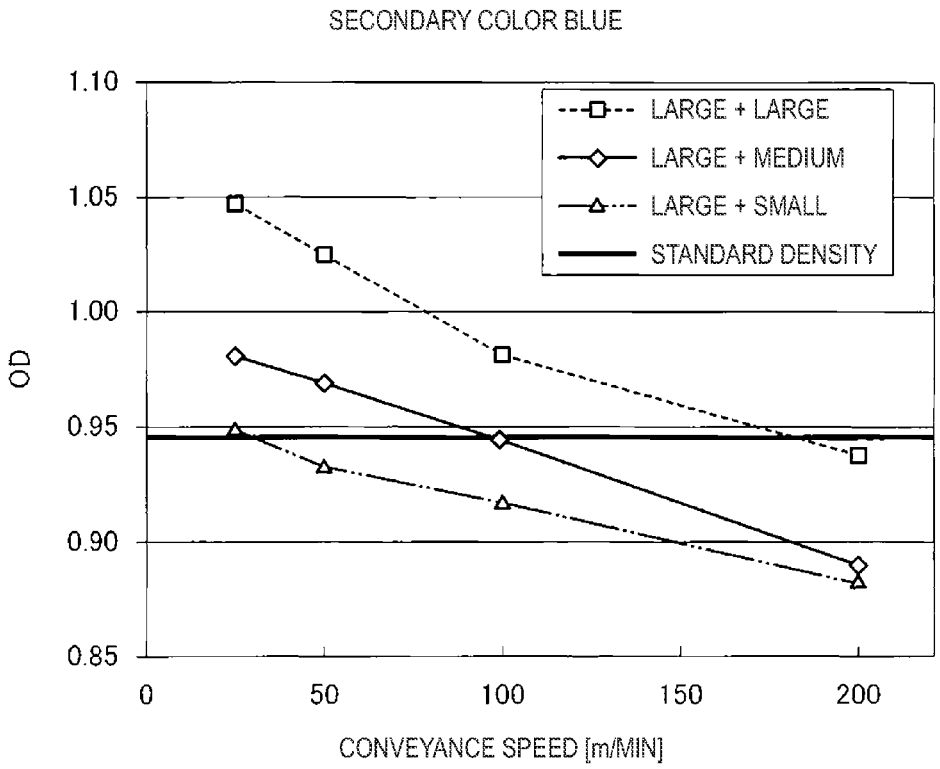
FIG. 5 is a graph illustrating a relationship between a conveyance speed and an optical density due to a size difference of liquid droplets of subsequent color magenta in a secondary color blue.

FIG. 5 illustrates a relationship between an optical density OD and the conveyance speed of the continuous paper P in a case that the starting color cyan C is ejected as a large droplet and the subsequent color magenta M is ejected as any one of a large droplet, a medium droplet, and a small droplet.

Referring to FIG. 5, if a target standard density is set to 0.945, when the conveyance speed is 30 m/minute, the starting color cyan C is ejected as a large droplet and the subsequent color magenta M is ejected as a small droplet, the standard density is 0.945. Further, when the conveyance speed is 100 m/minute, if the starting color cyan C is ejected as a large droplet and the subsequent color magenta M is ejected as a medium droplet, the standard density is 0.945. When the conveyance speed is 190 m/minute, if the starting color cyan C is ejected as a large droplet and the subsequent color magenta M is ejected as a large droplet, the standard density is 0.945.

Accordingly, a size of the subsequent color magenta M which is selected when an image formed of 100% of secondary color blue is formed to have an optical density of 0.945 (when approaching the optical density of 0.945) is selected as follows. A small droplet is selected at the conveyance speed of 30 m/minute or higher and less than 60 m/minute. A medium droplet is selected at the conveyance speed of 60 m/minute or higher and less than 120 m/minute. And, a large droplet is selected at the conveyance speed of 120 m/minute or higher and 200 m/minute or lower. The above result is stored in the storage unit of the control unit 20.

Similarly, a relationship, in which the standard density is set to 0.945, between the conveyance speed and the size of the ink drop of the subsequent color for the secondary color green and the secondary color red is obtained in advance by an experiment and stored in the storage unit of the control unit 20.

[Suppression of Variation in Color Space]

A case in which ΔE (color difference) of an image is reduced by suppressing variation in color space (L*a*b*) will be described with an example. In the example, an image is formed of 100% of secondary color red in which a starting color is magenta M and a subsequent color is yellow Y.

Figure 6:
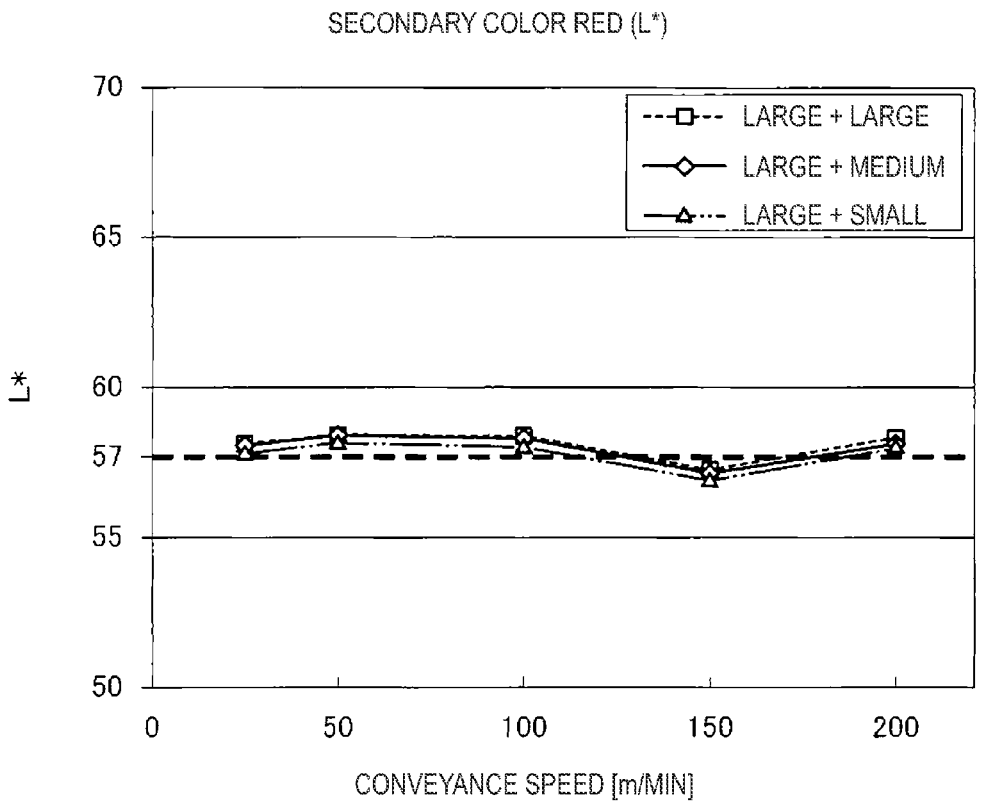
FIG. 6 is a graph illustrating a relationship between a conveyance speed and L* due to a size difference of liquid droplets of a subsequent color yellow in a secondary color red.

FIG. 6 illustrates a relationship between L* and the conveyance speed of the continuous paper P in a case that the starting color magenta M is ejected as a large droplet and the subsequent color yellow Y is ejected as any one of a large droplet, a medium droplet, and a small droplet.

Figure 7:
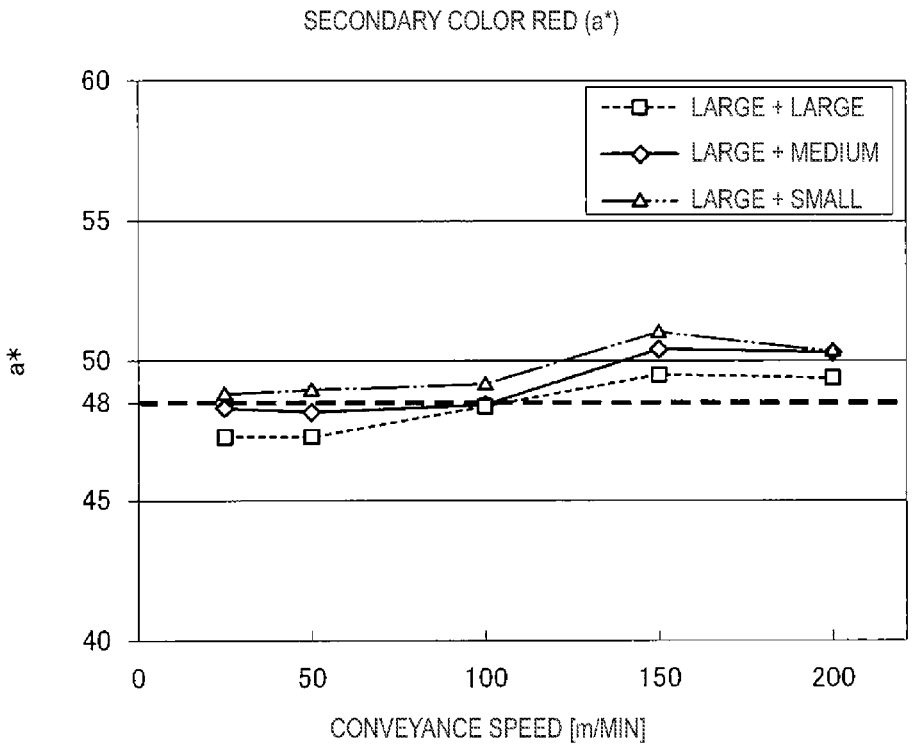
FIG. 7 is a graph illustrating a relationship between a conveyance speed and a* due to a size difference of liquid droplets of a subsequent color yellow in a secondary color red.

FIG. 7 illustrates a relationship between a* and the conveyance speed of the continuous paper P in a case that the starting color magenta M is ejected as a large droplet and the subsequent color yellow Y is ejected as any one of a large droplet, a medium droplet, and a small droplet.

Figure 8:
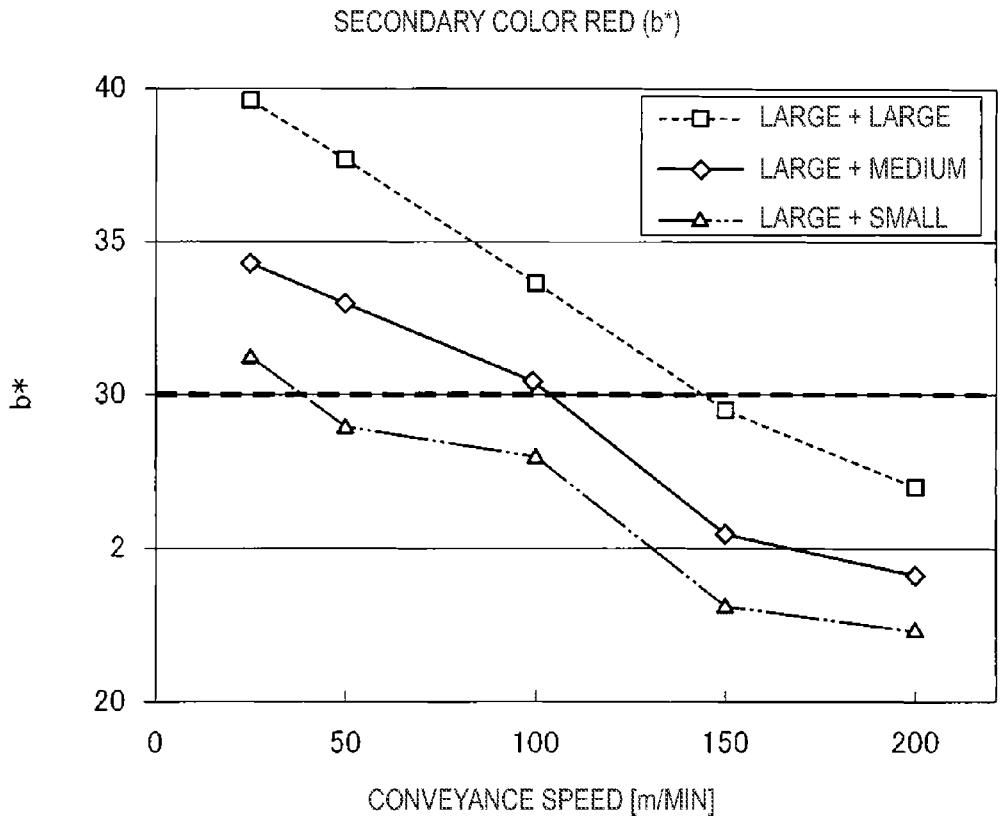
FIG. 8 is a graph illustrating a relationship between a conveyance speed and b* due to a size difference of liquid droplets of a subsequent color yellow in a secondary color red.

FIG. 8 illustrates a relationship between b* and the conveyance speed of the continuous paper P in a case that the starting color magenta M is ejected as a large droplet and the subsequent color yellow Y is ejected as any one of a large droplet, a medium droplet, and a small droplet.

As illustrated in FIGS. 6 and 7, L* and a* are substantially constant without depending on the size of the ink drop of the subsequent color yellow Y and the conveyance speed.

However, as illustrated in FIG. 8, b* is largely changed depending on the size of the ink drop of the subsequent color yellow Y and the conveyance speed.

Accordingly, when desired values of the secondary color red in the color space are assumed that L*=57, a*=48, and b*=30, as illustrated in FIGS. 6 to 8, referring to FIG. 8, if the conveyance speed is 40 m/minute, the starting color magenta M is ejected as a large droplet and the subsequent color yellow Y is ejected as a small droplet, the desired values of L*=57, a*=48, and b*=30 are obtained. Further, if the conveyance speed is 100 m/minute, the starting color magenta M is ejected as a large droplet and the subsequent color yellow Y is ejected as a medium droplet, the desired values of L*=57, a*=48, and b*=30 are obtained. Similarly, if the conveyance speed is 150 m/minute, the starting color magenta M is ejected as a large droplet and the subsequent color yellow Y is ejected as a large droplet, the desired values of L*=57, a*=48, and b*=30 are obtained.

Accordingly, a size of the subsequent color magenta M selected when an image formed of 100% of the secondary color red has the values of L*=57, a*=48, and b*=30 is selected as follows. A small droplet is selected at the conveyance speed of 30 m/minute or higher and less than 60 m/minute. A medium droplet is selected at the conveyance speed of 60 m/minute or higher and less than 120 m/minute. And, a large droplet is selected at the conveyance speed is 120 m/minute or higher and 200 m/minute or lower. The above result is stored in the storage unit of the control unit 20.

Similarly to this, sizes of the ink drops of the subsequent color for the secondary color blue and the secondary color green when desired values of L*, a*, and b* are obtained are obtained in advance by an experiment and stored in the control unit.

(Other Control)

A subsequent ink drop may be selected so as to suppress the variation of the optical density and the variation in color space to be balanced to suppress ΔE (color difference).

In the embodiment, when a secondary color image is formed using two color ink drops (liquid droplets) ejected from two different liquid droplet ejecting heads 70, as described above, the control unit 20 selects and ejects one of the large droplet, the medium droplet, and the small droplet of subsequent ink drops which are ejected from the liquid droplet ejecting heads 70 at the downstream side of the conveyance direction in accordance with the conveyance speed of the continuous paper P, subsequently to the ink drop (large droplet) which is ejected from the liquid droplet ejecting head 70 at the upstream side of the conveyance direction so that ΔE (color difference) of the image is reduced.

However, the size of the ink drop which is ejected from the liquid droplet ejecting head 70 at the upstream side of the conveyance direction may be selected from any one of the large droplet, the medium droplet, and the small droplet so that ΔE (color difference) of the image is reduced in accordance with the conveyance speed of the continuous paper P. Further, the size of the ink drop which is ejected from the liquid droplet ejecting head 70 at both the upstream side of the conveyance direction and the downstream side of the conveyance direction may be selected from any one of the large droplet, the medium droplet, and the small droplet so that ΔE (color difference) of the image is reduced in accordance with the conveyance speed of the continuous paper P.

The size of the ink drop is not limited to a configuration including three sizes of the large droplet, the medium droplet, and the small droplet. For example, the size may have a configuration including two sizes of the large droplet and the small droplet or a configuration which ejects four or more ink drops each having different liquid amount.

In any of the above configurations, a relationship between the conveyance speed and the size (a liquid amount per one drop) of the ink drop is obtained in advance by an experiment such that ΔE (color difference) of an image is reduced in accordance with the conveyance speed of the continuous paper P, and stored in the storage unit of the control unit 20.

(Control By Number of Liquid Droplets Per Unit Area)

If the liquid droplet ejecting head 70 cannot eject the liquid drops while changing the size of the ink drops, the number of liquid droplets per unit area is changed in accordance with the conveyance speed so that ΔE (color difference) of the image to be formed by the conveyance speed of the continuous paper P may be reduced.

Accordingly, hereinafter, a method of changing the number of liquid droplets per unit area will be described by way of an example.

Figure 9A:
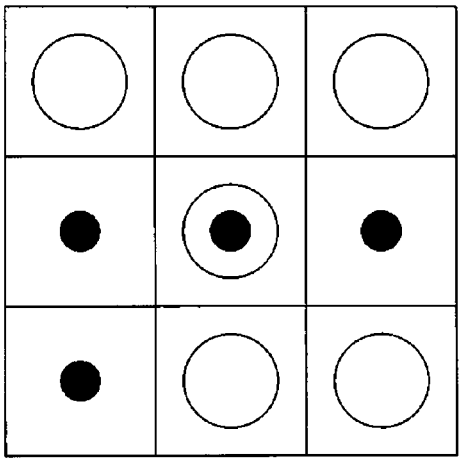

As illustrated in FIG. 9A, when the conveyance speed is low, six ink drops of a starting color which are illustrated by white circle (○) are ejected per unit area and four ink drops of a subsequent color which are illustrated by black circle (●) are ejected per unit area. However, as illustrated in FIG. 9B, when the conveyance speed is high, six ink drops of a starting color which are illustrated by white circle (○) are ejected per unit area and seven ink drops of a subsequent color which are illustrated by black circle (●) are ejected per unit area so that ΔE (color difference) of the image to be formed by the conveyance speed of the continuous paper P may be reduced.

Figure 9B:
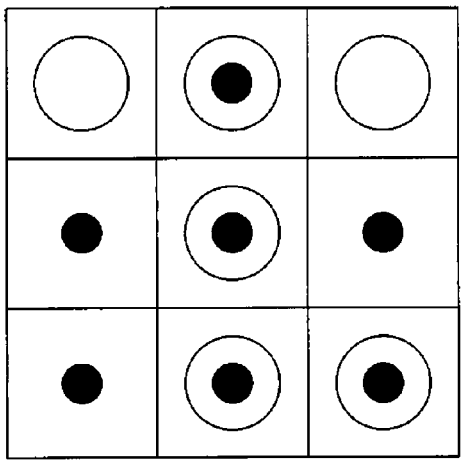

In the examples of FIGS. 9A and 9B, the number of ink drops (number of liquid droplets) of the subsequent color varies in accordance with the conveyance speed, but the present invention is not limited thereto. The number of ink drops of the starting color may vary in accordance with the conveyance speed or both the number of ink drops of the starting color and the number of ink drops of the subsequent color may vary in accordance with the conveyance speed.

In addition, if the liquid droplet ejecting head can eject the liquid drops while changing the size of the ink drops, both the size of the liquid droplet (liquid amount per one drop) and the number of liquid droplets per unit area may be changed in accordance with the conveyance speed.

<Others>

The present invention is not limited to the above-described embodiment.

For example, in the above embodiment, the configuration has four liquid droplet ejecting heads 70 of black K, cyan C, magenta M, and yellow Y, but is not limited thereto. For example, in addition to four liquid droplet ejecting heads 70, the configuration may have liquid droplet ejecting heads corresponding to light cyan, light magenta, and light yellow.

Even when a multi-color image is formed using ink drops (liquid droplets) of three or more colors which are ejected from three or more different liquid droplet ejecting heads 70, a size of the ink drop varies in accordance with the conveyance speed of the continuous paper P and a concentration of the liquid droplet per unit area which is ejected from the liquid droplet ejecting device is changed in accordance with the conveyance speed so as to reduce ΔE (color difference) of the image.

For example, in the above embodiment, the relationship between the conveyance speed and the concentration of the liquid droplet per unit area is obtained in advance by experiment, and stored in the storage unit of the control unit but the present invention is not limited thereto. The control unit may calculate a concentration of the liquid droplet per unit area ejected in accordance with the conveyance speed based on various information such as the conveyance speed or multicolor.

In brief, when a multi-color image is formed using liquid droplets of different colors which are ejected from two or more liquid droplet ejecting devices, the concentration of the liquid droplet per unit area which is ejected from the liquid droplet ejecting device may be changed in accordance with the conveyance speed such that the color difference is reduced.

For example, in the above embodiment, the present invention is applied to an image forming device which forms an image on a continuous paper P, but is not limited thereto. The present invention may also be applied to an image forming device which forms an image on a separate sheet of paper whose conveyance speed is variable.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device, comprising:

a conveying device that is capable of changing a conveyance speed of a recording medium;

a plurality of liquid droplet ejecting devices which is arranged in the order along a conveyance direction of the recording medium which is conveyed by the conveying device, the plurality of liquid droplet ejecting devices including at least a first liquid droplet ejecting device and a second liquid droplet ejecting device, the second liquid droplet ejecting device being located downstream from the first liquid droplet ejecting device in the conveyance direction; and a processor which changes a concentration of a liquid droplet per unit area which is ejected from the second liquid droplet ejecting device to be landed on the recording medium subsequent to the first liquid droplet ejecting device ejecting a liquid droplet onto the unit area, in accordance with the conveyance speed, when a multi-color image is formed using liquid droplets of different colors which are ejected onto the unit area from at least the first and second liquid droplet ejecting devices.

2. The image forming device of claim 1, wherein the processor changes a liquid amount per one drop to change the concentration of the liquid droplet per unit area.

3. The image forming device of claim 1, wherein the processor changes the number of liquid droplets per unit area to change the concentration of the liquid droplet per unit area.

4. The image forming device of claim 1, wherein a secondary color image as the multi-color image is formed using liquid droplets of different colors which are ejected from two of the plurality of liquid ejecting devices, and the processor changes the concentration of the liquid droplet per unit area which is ejected from one of the two liquid droplet ejecting devices at the downstream side of the conveyance direction so that the concentration of the liquid droplet per unit area based on said one of the two liquid droplet ejecting devices at the time of high conveyance speed of the recording medium is higher than the concentration of the liquid droplet per unit area based on said one of the two liquid droplet ejecting devices at the time of low conveyance speed of the recording medium.

5. The image forming device of claim 1, wherein the processor raises the concentration per unit area of the liquid droplet which is ejected from the liquid droplet ejecting device at a downstream side of the conveyance direction in accordance with the conveyance speed.

* * * * *